United States Patent [19]

Helzer

[11] 4,395,061

[45] Jul. 26, 1983

[54] SWIVEL UNIT

[75] Inventor: Lawrence E. Helzer, Buena Park, Calif.

[73] Assignee: Hughes Tool Company, Houston, Tex.

[21] Appl. No.: 273,821

[22] Filed: Jun. 15, 1981

[51] Int. Cl.[3] ..... F16L 27/00; F16L 17/02; F16L 21/00

[52] U.S. Cl. ..... 285/281; 285/98; 285/142; 285/276

[58] Field of Search ..... 285/281, 276, 280, 142, 285/140, 98

[56] References Cited

U.S. PATENT DOCUMENTS

| | | | |
|---|---|---|---|
| 1,113,397 | 10/1914 | Wright | 285/281 X |
| 1,190,209 | 7/1916 | York | 285/280 X |
| 1,514,871 | 11/1924 | Sperry | 285/281 X |
| 1,746,036 | 2/1930 | Gray | 285/281 X |
| 1,959,823 | 5/1934 | Greve | 285/281 |
| 2,279,969 | 4/1942 | Casperson | 285/276 X |

*Primary Examiner*—Richard J. Scanlan, Jr.

*Attorney, Agent, or Firm*—Robert A. Felsman; Charles D. Gunter, Jr.

[57] ABSTRACT

A swivel unit for inflatable packer drill stem test tools has an outer housing with a lower end adapted for connection to the drill stem and an upper end. An inner shaft has a base portion received within the outer housing and has a neck portion which protrudes from the outer housing. Tapered roller bearings located between the outer housing and inner shaft at opposing ends of the inner shaft base portion rotatably mount the outer housing about the inner shaft. The outer housing has a shoulder formed in its external surface for receiving the derrick elevators and supporting the test tool assembly.

5 Claims, 3 Drawing Figures

SWIVEL UNIT

BACKGROUND OF THE INVENTION

This invention relates to an improved swivel unit for inflatable packer drill stem test tool assemblies of the type used in testing oil and gas bearing zones.

Drill stem test (DST) tools are mounted in the drill stem or string and are used to evaluate the producing potential or productivity of an oil or gas bearing zone prior to completing a well. Thus, as drilling proceeds, various indications such as core samples may suggest the desirability of testing a certain formation for producing potential. To conduct the test, an inflatable packer and valve assembly is lowered on the drill stem into the uncased well bore to the zone to be tested. The packer is then set by rotation of the drill stem and the valve is opened for flow to the well surface.

The upper end of the DST assembly typically has attached a valve unit and a rigid steel hose through which the sample fluids are conducted. Since the lower portion of the DST assembly must be rotated to inflate the packers while the upper portion of the tool carrying the steel hose must remain stationary, a swivel unit is employed. Prior swivel units were mounted above the packers in the DST assembly and above a tool joint which was used to support the assembly above and below the joint. The usual derrick elevator was secured below the tool joint with the "control head" assembly, which connects the steel hose to the swivel unit, fitting between the elevator and derrick hook. In some situations, especially with smaller hook and elevator arrangements, this produced a cumbersome arrangement as adequate space was not available between the elevator and hook to accommodate the height of the control head. In addition, prior swivel units have had short service lives due to the side loads imposed upon the unit by the steel hose running from the tool to the derrick floor. This off-centered load has caused bearing failure in certain of the previous designs.

There exists a need for a swivel unit which provides adequate space above the derrick elevator and below the derrick hook for the control head which is able to withstand the side loads imposed by the steel hose running to the derrick floor.

SUMMARY OF THE INVENTION

The present swivel unit for inflatable packer drill stem test tool assemblies has an outer housing having a lower end adapted for connection to the drill stem test tool and having an upper end. An inner shaft has a base portion received within the outer housing and has a neck portion which protrudes from the outer housing. Bearing means are provided for rotatably mounting the outer housing about the inner shaft. The outer housing has a shoulder formed therein for supporting the drill stem test tool assembly.

In the preferred embodiment, tapered roller bearings are located between the outer housing and inner shaft at opposing ends of the inner shaft base portion for rotatably mounting the outer housing about the inner shaft. The tapered roller bearings are contained within the upper end of the outer housing above the shoulder. The shoulder formed in the outer housing is supported on the derrick elevator and the length of the assembly above the shoulder is sized to fit between the derrick elevator and hook while the distance between opposing tapered roller bearing locations is maximized.

Additional objects, features, and advantages of the invention will be apparent in the following description.

FIG. *2a* is a side cross-sectional view of the upper half of the swivel unit of the invention.

FIG. *2b* is a side cross-sectional view of the lower half of the device of FIG. *2a*.

DETAILED DESCRIPTION OF THE INVENTION

Figure 1:
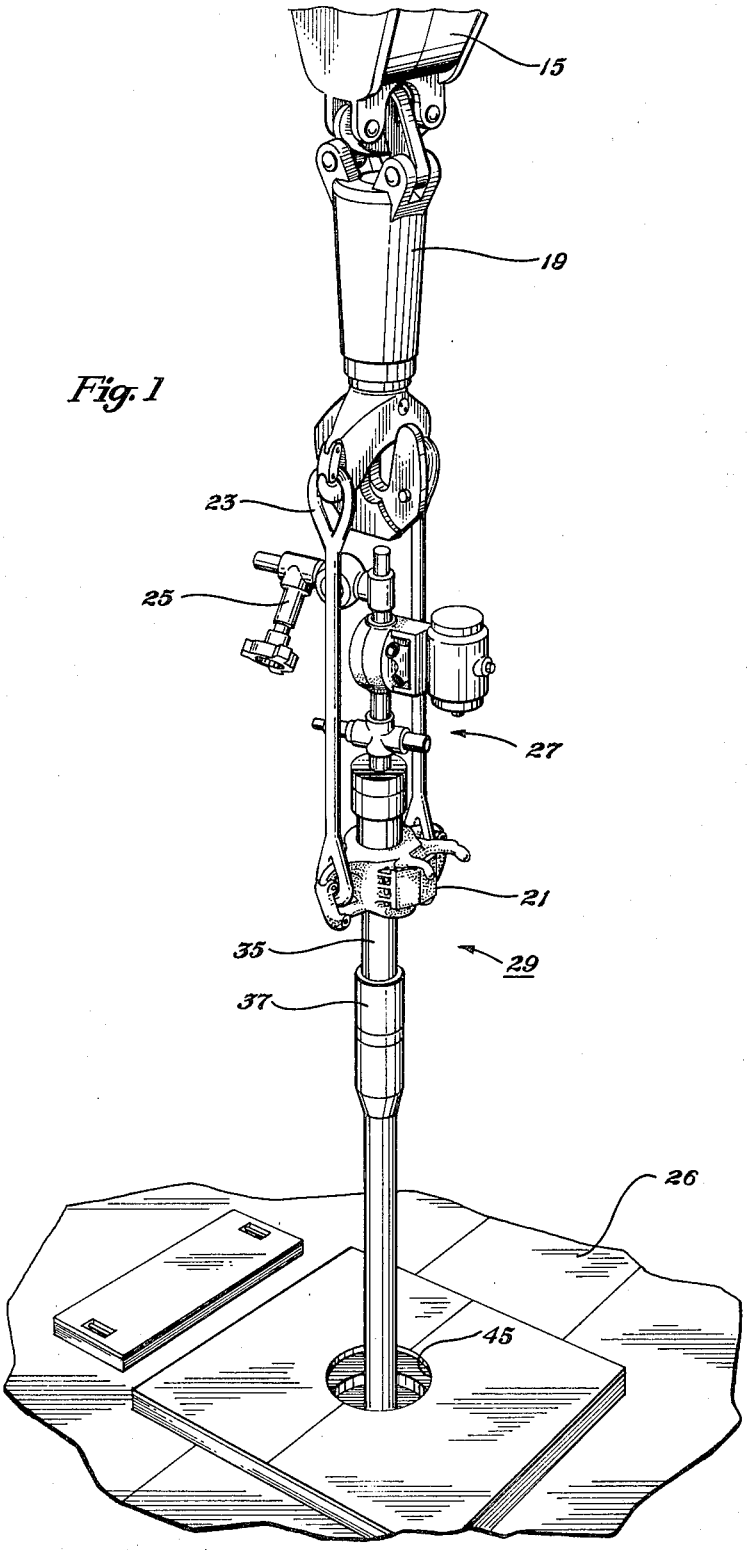
FIG. 1 is a perspective view of the swivel unit of the invention supported on the derrick elevators.

FIG. 1 is a perspective view of a portion of a derrick showing the swivel unit, designated generally as 29. The usual hook 19 is carried by the derrick traveling block 15 and supports a derrick elevator 21 by means of a pair of links 23. A rigid steel hose 25 runs from the derrick floor 26 to a control head assembly, designated generally as 27, on top of the inflatable packer swivel unit 29.

As shown in FIG. *2a*, the swivel unit 29 includes an outer housing 31 having a generally cylindrical upper end 33 of relatively greater external diameter and a generally cylindrical lower end 35 of lesser external diameter. Lower end 35 of outer housing 31 has formed therein a tool joint 37 having a pin end 39 with external threads 41 adapted for connection to the box end of the drill stem.

Lower end 35 of outer housing 31 is connected to upper end 33 by a downwardly facing shoulder 47 adapted to be received by the derrick elevators 21 to thereby support the drill stem test tool assembly in the well bore 45. Lower end 35 of outer housing 31 has a thru bore 49 for the passage of well fluids. Upper end 33 of outer housing 31 has a central inner bore 51 of relatively greater diameter which narrows to form a bottom bore 55 of lesser internal diameter. Central inner bore 51 increases in internal diameter at the end 56 opposite bottom bore end 55 to form an offset 58. A cylindrical end piece or "cap" 34 is threadedly received within end 56 and is sealingly engaged by means of an o-ring 62.

Central inner bore 51 in upper end 33 is adapted to receive a shaft 57. Shaft 57 has a base portion 59 received within bore 51 of upper end 33, a lower extent 61 received within bottom bore 55 of upper end 33, and a neck portion 63 which protrudes from cylindrical opening 53 in cap 34. Shaft 57 has a thru bore 65 for the passage of well fluids which is alignable with thru bore 49 in lower end 35 when lower extent 61 is received within bottom bore 55. Neck portion 63 of shaft 57 terminates in a top end 67 which is externally threaded to engage the internal threads 69 of control head assembly 27 which connects to a rigid steel hose 25 running to the derrick floor.

A ledge 75 is formed at the junction of neck portion 63 and base portion 59 of shaft 57. Ledge 75 supports a biasing means such as a coned-disk or "Belleville" spring 77. Bearing means, in this case, upper tapered roller bearing assembly 81 and lower tapered roller bearing assembly 83 rotatably mount the outer housing 31 about inner shaft 57. The tapered roller bearing assemblies are located between outer housing 31 and inner shaft 57 at opposing ends of the shaft base portion 59. Upper bearing assembly 81 comprises spring biased inner ring or cone 85 supported on ledge 75, an outer ring or cup 89, and a series of tapered rollers 87 sandwiched between cone 85 and cup 89.

Lower extent 61 of inner shaft 57 joins base portion 59 to form a lower ledge 91. Lower ledge 91 receives the cone 93 of the opposing lower bearing assembly 83. Bearing assembly 83 also has an outer ring or cup 95 and a series of tapered rollers 97 sandwiched between cone 93 and cup 95. Cups 89 and 95 are maintained in place by means of oppositely facing indentations 99 and 101, respectively, in the interior surface of cap 34 and upper end 33.

The base portion 59 of inner shaft 57 is thus received within the inner bore 51 of upper end 33 and rotably mounted therein by means of upper and lower tapered roller bearing assemblies 81, 83. Spring 77 serves to preload the upper tapered roller bearing assembly 81 to ensure a snug fit and compensate for manufacturing tolerances. When inner shaft 57 is received within upper end 33, and annular opening 103 is provided between the exterior surface of base portion 59 and the central inner bore 51 of upper end 33. Plugs 113, 115 in longitudinal passages 109, 111, respectively, are provided so that a "punch" can be inserted behind the bearing caps for ease of removal of the bearing assemblies 81, 83. Plug 117 provides a side inlet into annular opening 103 which communicates with clearances 105, 107 around bearing assemblies 81, 83, and communicates with longitudinal passages 109, 111 in cap 34 and upper end 33 for introduction of a suitable lubricant.

Figure 2A:
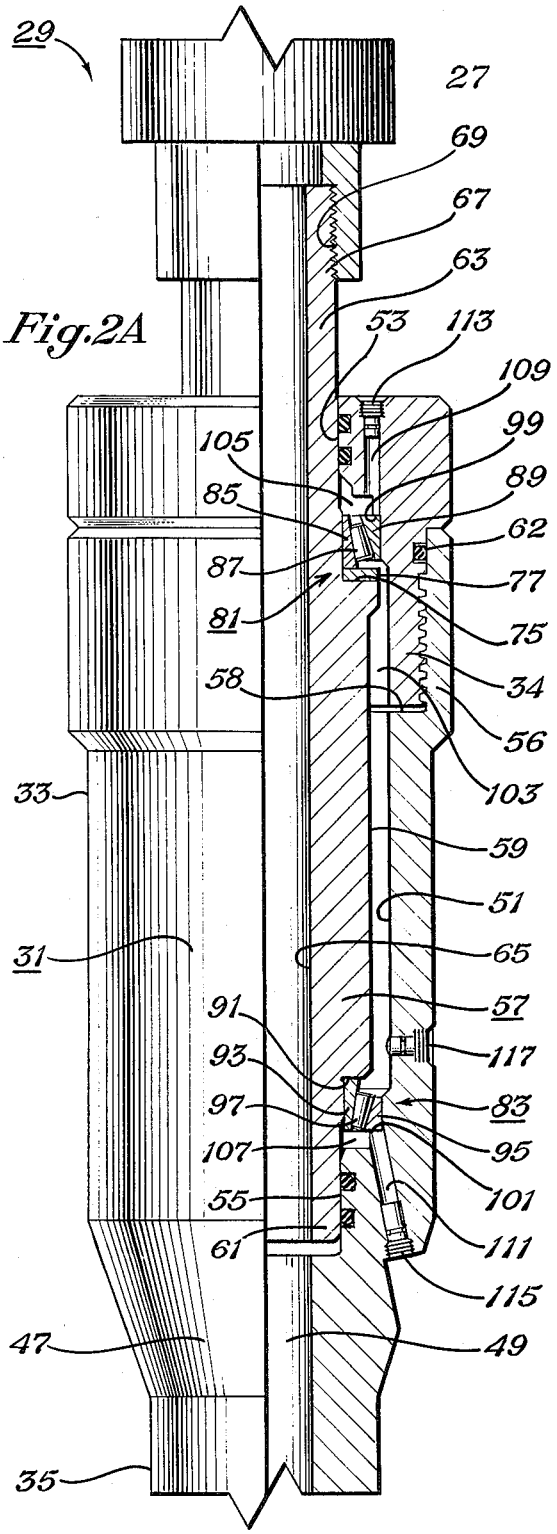
Figure 2B:
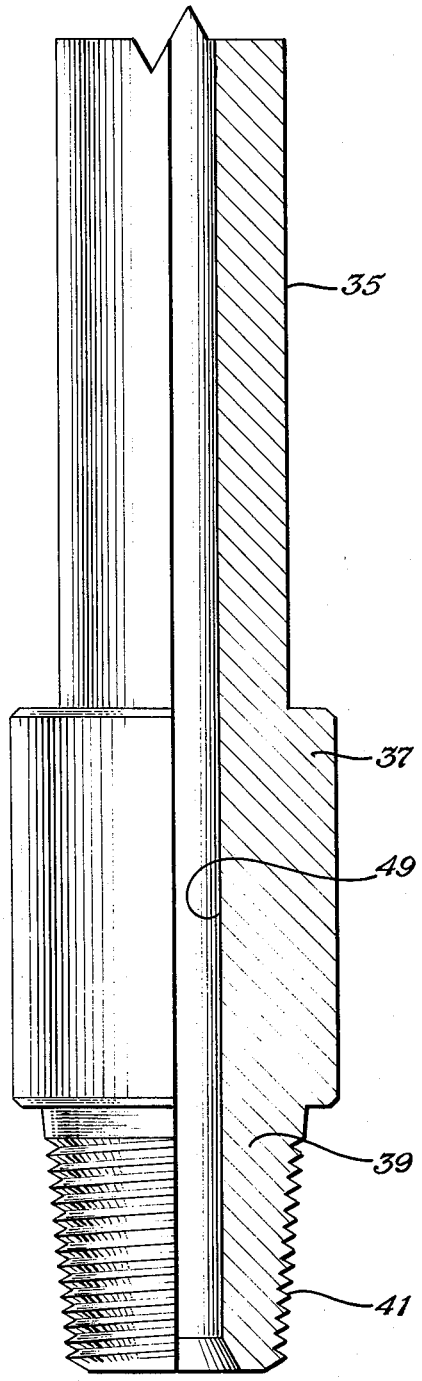

The operation of the invention will now be described in greater detail. The swivel unit 29 as shown in FIGS. 2*a* and 2*b* is assembled in the DST tool by connecting the external threads 41 of pin end 39 to the drill stem which contains the inflatable packer test tools. The top end 67 of the swivel unit 29 is connected to the control head assembly 27 which connects to the rigid steel hose 25 running to the derrick floor. The derrick elevators are secured about outer housing 31 with shoulder 47 resting on the elevator. The swivel assembly 29 thus supports the weight of the drill stem in the well bore while picking up or setting down weight to manipulate the tools downhole. When rotating the drill stem, the derrick "slips" support the weight of the drill stem and the elevators are disengaged from the swivel.

The axial load of the control head assembly 27, and hose 25, is born by the lower bearing assembly 83. The side or radial load imposed upon the swivel unit 29 by the off center load of the hose 25 is born by the upper bearing assembly 81. Once the packers are placed at the desired level and inflated to seal off the zone to be tested, a valve in the drill stem test tool is opened to allow the fluid sample to flow through bores 49 and 65 to the well surface.

In order to reduce the side load imposed on upper bearing assembly 81, the distance between the opposed tapered roller bearing assemblies 81, 83 is maximized. The greater the distance between bearing assemblies 81, 83, the more stable the bearing arrangement produced. The distance between bearing assemblies 81 and 83 is limited, however, by the fact that upper end 33 above shoulder 47 and elevator 21 must fit beneath the derrick hook 19. The distance between bearing assemblies 81, 83 is thus maximized while keeping the overall outer dimensions of upper end 33 within manageable proportions. In the preferred embodiment, the distance between bearing assemblies 81, 83 is approximately half the length of shaft 57.

The invention has been provided with significant advantages. The swivel unit has an extremely sturdy bearing arrangement designed to hold up under side loads imposed on the shaft portion of the unit. By providing an elevator shoulder in the exterior surface of the upper end of the unit, the bearing assemblies can be spaced apart to provide a mechanical advantage while keeping the overall length of the unit above the elevators within allowable limits.

I claim:

1. A swivel unit for an inflatable packer drill stem test tool assembly, comprising:

an outer housing having a lower end adapted for connection to said drill stem test tool and having an upper end;

an inner shaft having a base portion received within said outer housing and having a neck portion protruding from said outer housing;

bearing means for rotatably mounting said outer housing about said inner shaft; and wherein said outer housing has a downwardly facing shoulder formed in the exterior surface thereof for supporting said assembly.

2. A swivel unit for an inflatable packer drill stem test tool assembly, comprising:

an outer housing having a lower end adapted for connection to said drill stem test tool and having an upper end;

an inner shaft having a base portion received within said outer housing and having a neck portion protruding from said outer housing;

tapered roller bearings located between said outer housing and inner shaft at opposing ends of said inner shaft base portion for rotatably mounting said outer housing about said inner shaft; and wherein said outer housing has a shoulder formed therein for supporting said assembly.

3. A swivel unit for an inflatable packer drill stem test tool assembly of the type used in a drill rig having a traveling block, a hook supported from the traveling block, and derrick elevators supported from the hook by elevator links, comprising:

an outer housing having a lower end adapted for connection to said drill stem test tool and having an upper end;

an inner shaft having a base portion received within said outer housing and having a neck portion protruding from said outer housing;

tapered roller bearings located between said outer housing and inner shaft at opposing ends of said inner shaft base portion for rotatably mounting said outer housing about said inner shaft; and wherein said outer housing has a shoulder formed therein for receiving said derrick elevators and thereby supporting said assembly.

4. The swivel unit of claim 3, wherein said opposing tapered roller bearings are contained within the upper end of said outer housing above said shoulder.

5. The swivel unit of claim 4, wherein the length of the assembly above said shoulder is sized to fit between said elevators and said hook while the distance between said opposing tapered roller bearing locations is maximized.

* * * * *